US009523236B2

(12) United States Patent
Bergamaschi

(10) Patent No.: US 9,523,236 B2
(45) Date of Patent: Dec. 20, 2016

(54) BRAKING MECHANISM FOR A ROLLER SHADE CONTROLLER, CONTROL MECHANISM COMPRISING SAME AND CONTROL HANDLE

(71) Applicant: ALTEX DECORATION LIMITEE, Terrebonne (CA)

(72) Inventor: Giovanni Bergamaschi, Bologna (IT)

(73) Assignees: Altex Decoration Limitee, Terrebonne, Quebec (CA); S.P. Engineering S.R.L., Castel Maggiore, Bologna (IT)

( * ) Notice: Subject to any disclaimer, the term of this patent is extended or adjusted under 35 U.S.C. 154(b) by 0 days.

(21) Appl. No.: 14/158,335

(22) Filed: Jan. 17, 2014

(65) Prior Publication Data

US 2014/0196857 A1 Jul. 17, 2014

Related U.S. Application Data

(60) Provisional application No. 61/753,647, filed on Jan. 17, 2013.

(51) Int. Cl.

| | |
|---|---|
| ***E06B 9/84*** | (2006.01) |
| ***E06B 9/42*** | (2006.01) |
| ***E06B 9/50*** | (2006.01) |
| ***E06B 9/60*** | (2006.01) |
| ***E06B 9/78*** | (2006.01) |
| ***E06B 9/90*** | (2006.01) |

(52) U.S. Cl.

CPC . *E06B 9/42* (2013.01); *E06B 9/50* (2013.01); *E06B 9/60* (2013.01); *E06B 9/78* (2013.01); *E06B 9/84* (2013.01); *E06B 9/90* (2013.01); *E06B 2009/785* (2013.01); *E06B 2009/905* (2013.01)

(58) Field of Classification Search

CPC ..... E06B 9/84; E06B 9/90
USPC ..... 160/297, 321, 300, 301; 49/322
See application file for complete search history.

(56) References Cited

U.S. PATENT DOCUMENTS

| | | | | | |
|---|---|---|---|---|---|
| 949,304 | A | * | 2/1910 | Pond et al. | 160/297 |
| 961,680 | A | * | 6/1910 | Cole | 160/297 |
| 2,614,629 | A | * | 10/1952 | Bleibtreu | 160/297 |
| 2,891,614 | A | * | 6/1959 | Grupp | 160/301 |
| 3,211,212 | A | * | 10/1965 | Smith | 160/298 |
| 4,096,904 | A | * | 6/1978 | Donofrio | 160/299 |
| 4,250,942 | A | * | 2/1981 | Dreher et al. | 160/297 |
| 4,305,447 | A | * | 12/1981 | Persson | 160/297 |
| 4,345,636 | A | * | 8/1982 | Fukuchi | 160/297 |
| 5,099,906 | A | * | 3/1992 | Chigusa et al. | 160/297 |
| 5,586,631 | A | * | 12/1996 | Benthin | 192/223.2 |

(Continued)

*Primary Examiner* — David Purol
(74) *Attorney, Agent, or Firm* — Merchant & Gould P.C.

(57) ABSTRACT

A braking mechanism for a roller shade control system. The braking mechanism includes a stationary member and a rotating member rotatable relative to the stationary member. The rotating member is rotatable in a winding direction or an unwinding direction. The braking mechanism also includes a connecting assembly operatively connecting the stationary member and the rotating member. The connecting assembly frictionally engages the rotating member when the rotating member is rotated in the unwinding direction and is frictionally disengaged from the rotating member when the rotating member is rotated in the winding direction. A control mechanism includes such a braking mechanism and an operating handle for operating the control mechanism.

13 Claims, 10 Drawing Sheets

(56) References Cited

U.S. PATENT DOCUMENTS 6,131,642 A * 10/2000 Welfonder ..... 160/301
6,530,717 B1 * 3/2003 Bergamaschi ..... 403/325

* cited by examiner

BRAKING MECHANISM FOR A ROLLER SHADE CONTROLLER, CONTROL MECHANISM COMPRISING SAME AND CONTROL HANDLE

This application claims benefit of Ser. No. 61/753,647, filed 17 Jan. 2013 in the United States and which application is incorporated herein by reference. To the extent appropriate, a claim of priority is made to each of the above disclosed applications.

FIELD OF THE INVENTION

The present invention relates to the field of roller shades controllers. More particularly, it relates to a braking mechanism for a roller shade controller, a control mechanism comprising such a braking mechanism and a control handle for controlling such control mechanism.

BACKGROUND

Numerous types of control devices for window roller shades are known in the art for winding and unwinding a roller shade around a tubular core when actuated by a user, and maintaining the shade in a stable desired position when not actuated.

However, known control devices often do not offer a precise control of the positioning of the shade to the user actuating the controller. For example, in many instances, the locking mechanism of a control device, which allows the shade to be maintained in the desired stable position, becomes effective only subsequently to a full revolution of the tubular core. Such an arrangement is ineffective for users requiring precise positioning of the shade, as the additional revolution varies the position of the shade after the user has stopped interacting with the controller.

Other control devices offer improved positioning capabilities through friction based braking systems. In these systems, friction of the components of the device is used to hinder rotation and maintain the shade in a desired position when not actuated. However, known friction based braking systems are active both when the roller shade is wound and unwound and therefore require an additional displacement force to be applied by the user both when the shade is moved up or down, which can be undesirable.

Moreover, control devices often operate slowly for the winding/unwinding of the window shade. The slow winding/unwinding of the window shade is particularly disadvantageous for shades having a long length, which are increasingly present in the market. The slow winding/unwinding can often be explained by the fact that numerous control devices found on the market operate directly on the tubular core onto which the shade is rolled. Consequently, an operator must often pull on an extremity of the activating chain or rope several times before the desired position of the window shade is reached, which can be long and tiresome. In addition, given the length of the chain or rope required for winding/unwinding the shade completely, the ends of the chain or rope are often required to meet, in order to form a dosed loop. In most cases, the formed loops are long and can be found within the reach of children, which can lead to important security issues.

In view of the above, there is a need for an improved braking mechanism and control device for window roller shades, which by virtue of its design and components, would be able to overcome or at least minimize some of the above-discussed prior art concerns.

SUMMARY OF THE INVENTION

According to a first general aspect, there is provided a braking mechanism for a roller shade control system. The braking mechanism comprises a stationary member and a rotating member rotatable relative to the stationary member. The rotating member is rotatable in a winding direction or an unwinding direction. The braking mechanism also comprises a connecting assembly operatively connecting the stationary member and the rotating member. The connecting assembly frictionally engages the rotating member when the rotating member is rotated in the unwinding direction and is frictionally disengaged from the rotating member when the rotating member is rotated in the winding direction.

In an embodiment, the stationary member comprises at least one recess formed therein. The at least one recess has a bottom wall extending between a first extremity having a first depth and a second extremity having a second depth greater than the first depth. The braking mechanism also comprises a braking element located within at least one of the at least one recess. Each braking element is sized and shaped to engage the bottom wall and the rotating member at the first extremity and to disengage the bottom wall from the rotating member at the second extremity.

According to another general aspect, there is also provided a control mechanism for a roller shade. The control mechanism comprises a tubular core onto which the roller shade is wrappable. The tubular core is rotatable in a winding direction or an unwinding direction. The control mechanism also comprises an actuation assembly having an actuation member. The actuation assembly is operable to rotate the tubular core in the winding direction or the unwinding direction. The control mechanism further comprises a braking mechanism operatively connected to the actuation assembly. The braking mechanism comprises a stationary member and a rotating member rotatable relative to the stationary member. The rotating member is operatively connected to the tubular core to be rotatable in the winding direction or the unwinding direction simultaneously with the tubular core. The braking mechanism also comprises a connecting assembly operatively connecting the stationary member and the rotating member, the connecting assembly frictionally engages the rotating member when the rotating member is rotated in the unwinding direction and is frictionally disengaged from the rotating member when the rotating member is rotated in the winding direction.

In an embodiment, the actuation member comprises an operating handle at at least one of a first end of the actuation member or a second end of the actuation member. The operating handle has a main body operatively connected to the actuation member by a dampening mechanism for dampening relative motion between the main body and the actuation member.

According to yet another general aspect, there is also provided an operating handle for operating a control mechanism for a roller shade having an actuation member. The operating handle comprises a body operatively connectable to the actuation member and a dampening mechanism for dampening relative motion between the body and the actuation memberactuation member.

BRIEF DESCRIPTION OF THE DRAWINGS

Other objects, advantages and features will become more apparent upon reading the following non-restrictive description of embodiments thereof, given for the purpose of exemplification only, with reference to the accompanying drawings in which.

DETAILED DESCRIPTION

In the following description, the same numerical references refer to similar elements. The embodiments, geometrical configurations, materials mentioned and/or dimensions shown in the figures or described in the present description are preferred embodiments only, given solely for exemplification purposes.

Moreover, although the embodiments of the braking mechanism, control mechanism, handle and corresponding parts thereof consist of certain geometrical configurations as explained and illustrated herein, not all of these components and geometries are essential to the invention and thus should not be taken in their restrictive sense. It is to be understood, as also apparent to a person skilled in the art, that other suitable components and cooperation thereinbetween, as well as other suitable geometrical configurations, may be used for the braking mechanism, control mechanism and handle, as will be briefly explained herein and as can be easily inferred herefrom by a person skilled in the art. For example, certain features of the braking mechanism, control mechanism and handle shown in the illustrated embodiments as being cylindrical are not limited to such shapes and any other geometry that can accomplish an equivalent mechanical function can be substituted. Moreover, it will be appreciated that positional descriptions such as "above", "below", "left", "right" and the like should, unless otherwise indicated, be taken in the context of the figures and should not be considered limiting.

Figure 1:
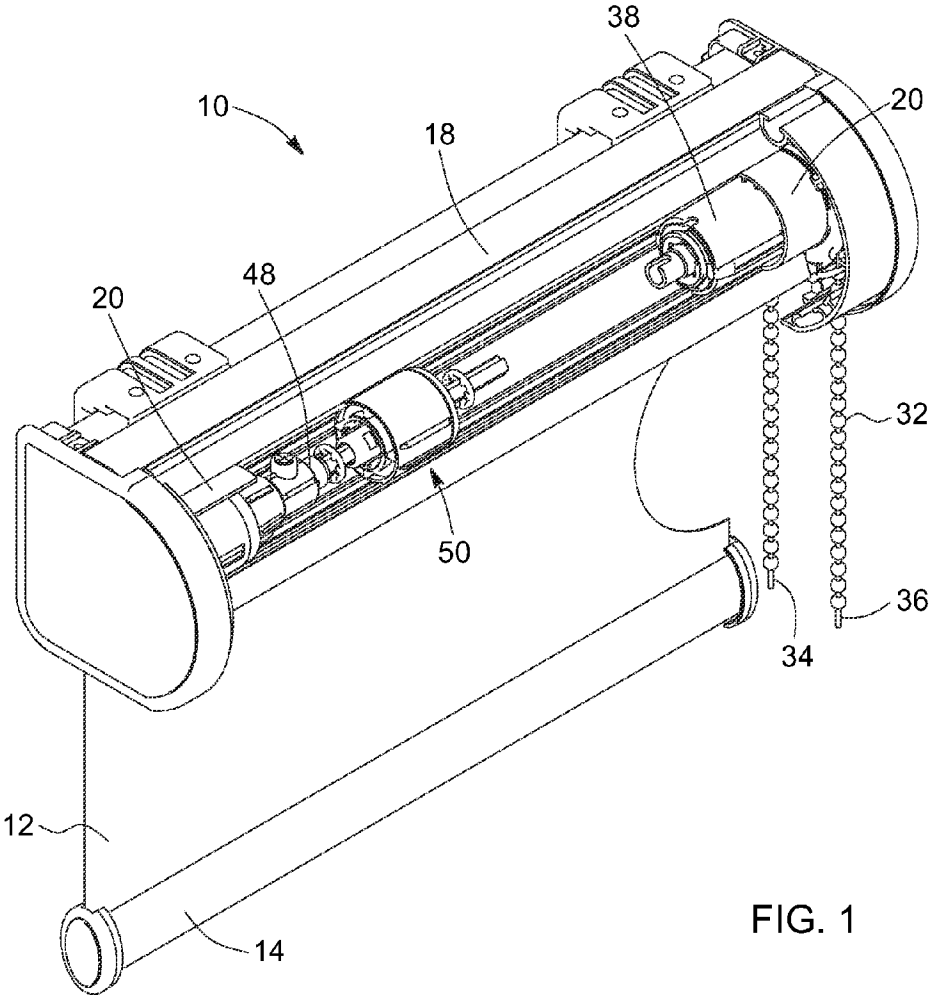
FIG. 1 is a perspective view of a control mechanism for a roller shade in accordance with an embodiment and where only a portion of the tubular core is shown.
Figure 2:
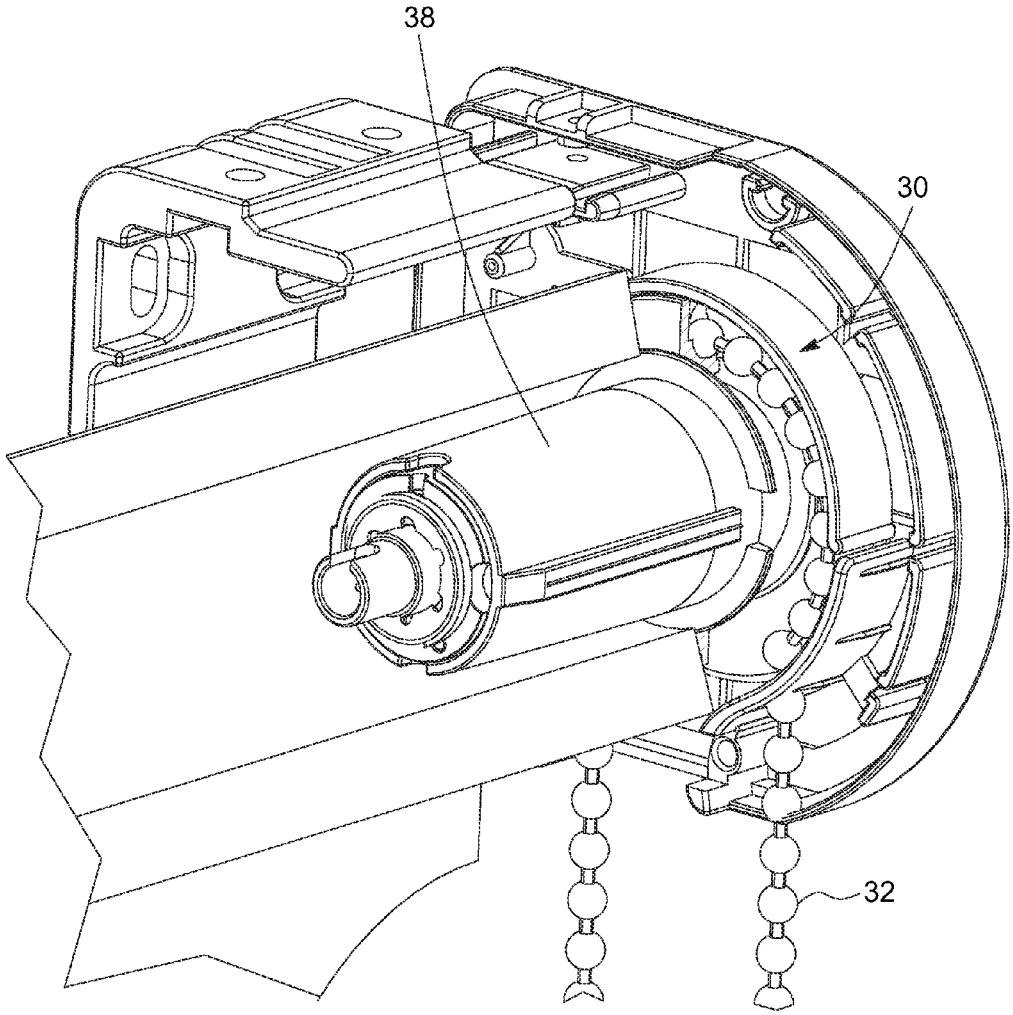
FIG. 2 is a close-up perspective view of an actuation assembly of the control mechanism for a roller shade of FIG. 1 where the section of the drive unit connecting with the activating member is only partially shown.
Figure 3:
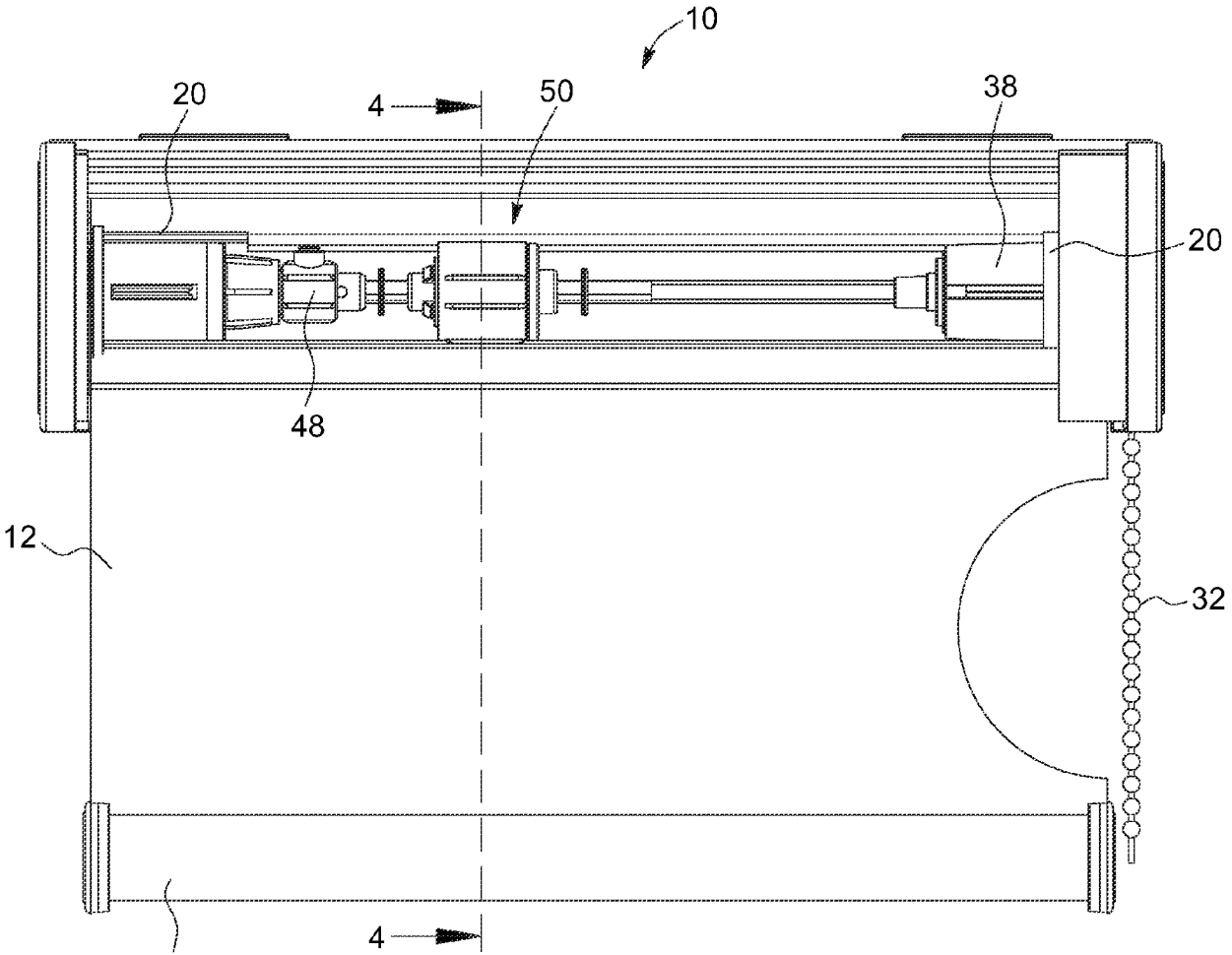
FIG. 3 is a front elevation view of the control mechanism for a roller shade of FIG. 1.

Referring generally to FIGS. 1 to 3, in accordance with one embodiment, there is provided a control mechanism 10 for winding and unwinding a roller shade 12 around a tubular core 20. In an embodiment, the control mechanism 10 is provided within a housing 18 mountable to a wall or a ceiling (not shown), proximate to a window (not shown) such that, when the roller shade 12 is unwound, it covers the surface of the corresponding window, thereby providing privacy and light blocking or filtering. One skilled in the art will however understand that the housing 18 containing the control mechanism 10 could be mounted to different structures, for example and without being limitative, for the shade to be used as a separator in a room.

Figure 4:
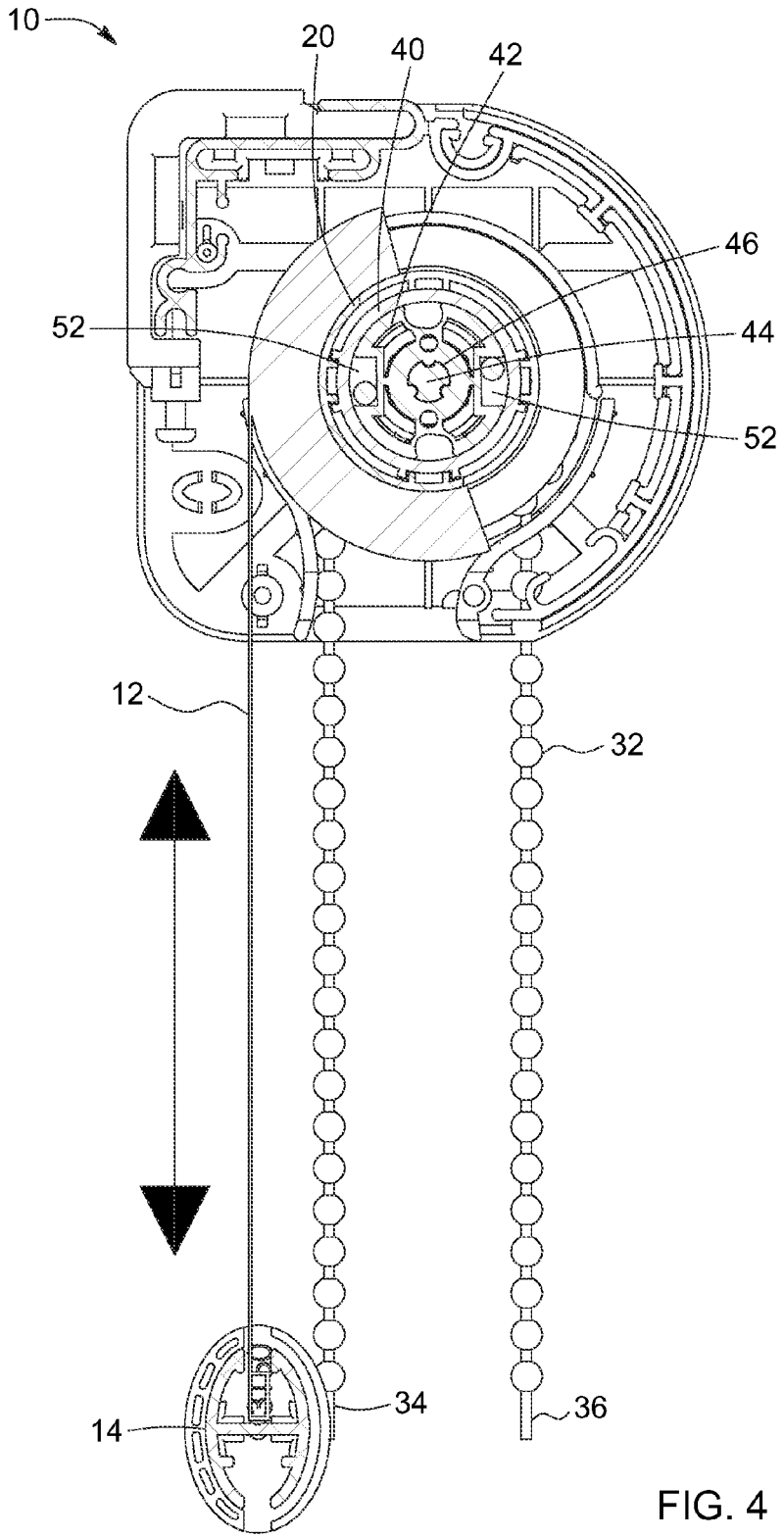
FIG. 4 is a cross-sectional view of the control mechanism for a roller shade of FIG. 3 taken along line 4-4 to show the internal components of the braking mechanism.

As can be seen in the illustrated embodiment of FIGS. 1 to 3, the control mechanism 10 has an actuation assembly 30 with an actuation member 32 for a user to operate the control mechanism 10 and wind/unwind the roller shade 12. In the illustrated embodiment, the actuation member 32 is a chain, for example a ball chain, however, one skilled in the art will understand that in alternative embodiments, other components, such as a cord or the like, could be used. As better shown in FIG. 4, unwinding of the roller shade 12 can be effected by pulling on a first end 34 of the actuation member 32, or directly by pulling on the weighted hem bar 14 of the roller shade 12. However, winding of the roller shade 12 requires pulling on the second 36 end of the actuation member 32. It will be easily understood that, in alternative embodiments, the first end 34 and the second end 36 of the actuation member 32 could be inverted, depending on the direction in which the shade 12 is wound on the tubular core 20.

In the illustrated embodiment, and as better shown in FIG. 2, the actuation assembly 30 has a drive unit 38 operatively connected to the actuation member 32, such that the drive unit 38 is rotatably driven by the actuation member 32.

Now referring to FIG. 1, as can be seen, a tubular core 20 surrounds the drive unit 38 and is secured thereto by complementary flanges extending from the exterior surface of the drive unit 38 and the interior surface of the tubular core 20. A person skilled in the art would however understand that any other means for securing the tubular core 20 around the drive unit 38, such as a press fit, and resulting in both components being securable to one another, could be used.

Now referring to FIGS. 1 and 3, even though only sections of the tubular core 20 are shown in order to better show the braking mechanism, it should be understood that the tubular core 20 extends longitudinally between the section shown on the left and the section shown on the right of the Figures. The tubular core 20 is connected along at least part of its length to a braking mechanism 50. Similarly to the connection with the drive unit 38, the tubular core 20 is secured to the braking mechanism 50 by complementary flanges extending from the exterior surface of the braking mechanism 50 and the interior surface of the tubular core 20. The connection of the tubular core 20 with the drive unit 38 and the braking mechanism 50 results in a functional connection between the braking mechanism 50 and the drive unit 38, such that the drive unit 38 and the braking mechanism 50 rotate simultaneously. Therefore, the braking mechanism 50 is driven in a winding direction corresponding to the direction in which the shade 12 is wound on the tubular core 20 or an unwinding direction in which the shade 12 is unwound from the tubular core 20, depending on the rotation of the drive unit 38.

As will be understood by a person skilled in the art, in alternative embodiments, the tubular core 20 could be connected to more than one braking mechanism 50 along part of its length, if more braking power is required.

Now referring to FIGS. 1 and 3 to 7, the braking mechanism 50 has a rotating member 40 surrounding a stationary member 42. The size of the rotating member 40 and the stationary member 42 is configured such that the stationary member 42 does not hinder the rotation of the rotating member 40, which can freely rotate thereon. The stationary member 42 is held in a fixed position by a stationary central shaft 44 connected at one end to a fixating member 48 and going through a central bore 46 of the stationary member 42. The shapes of the stationary central shaft 44 and the central bore 46 of the stationary member 42 are configured such that the stationary member 42 cannot rotate thereon. Therefore the rotation of the stationary member 42 is prevented by the fixed position of the stationary central shaft 44.

Figure 5:
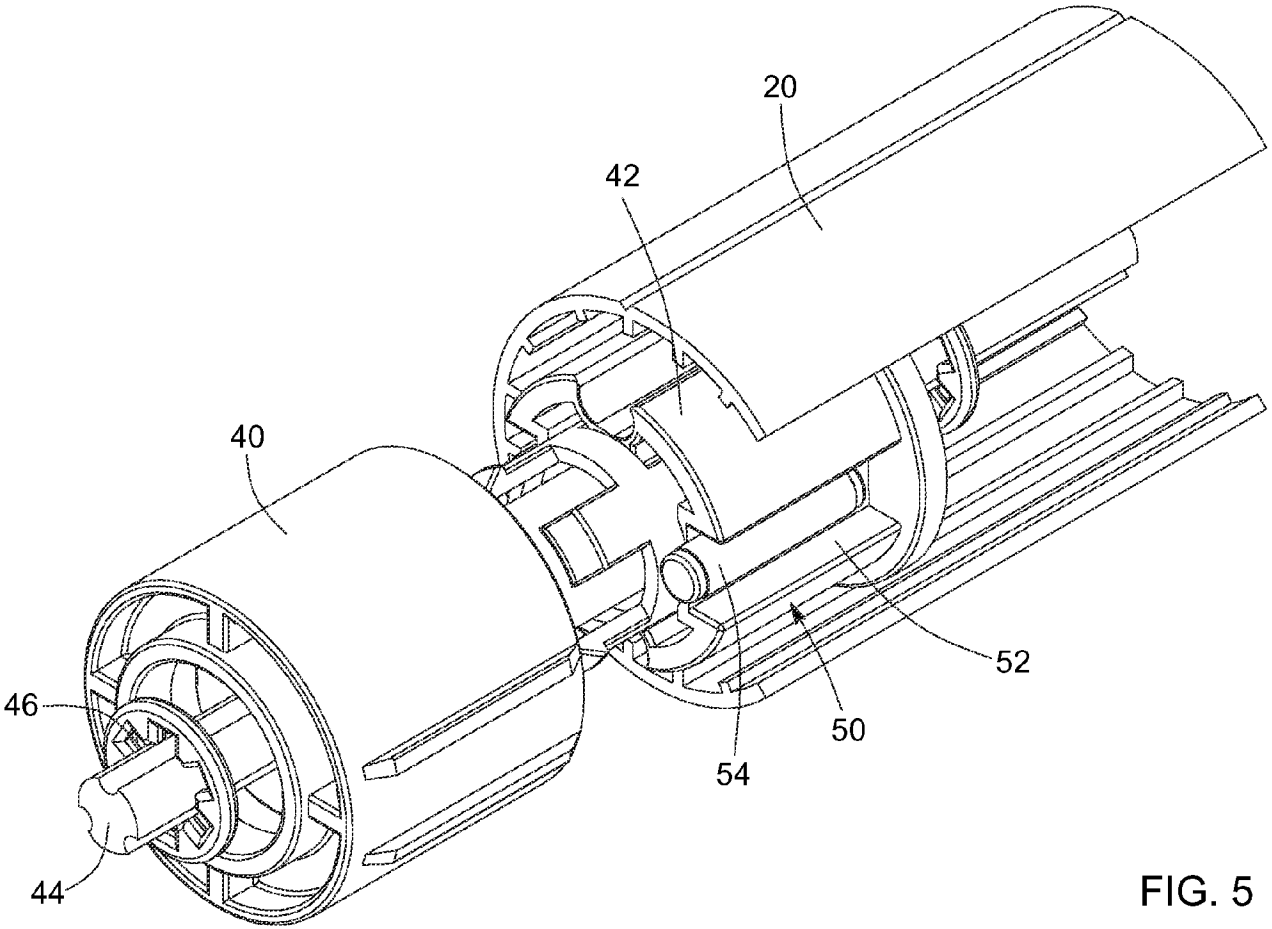
FIG. 5 is an exploded view of the tubular core and braking mechanism of the control mechanism for a roller shade of FIG. 1.
Figure 6:
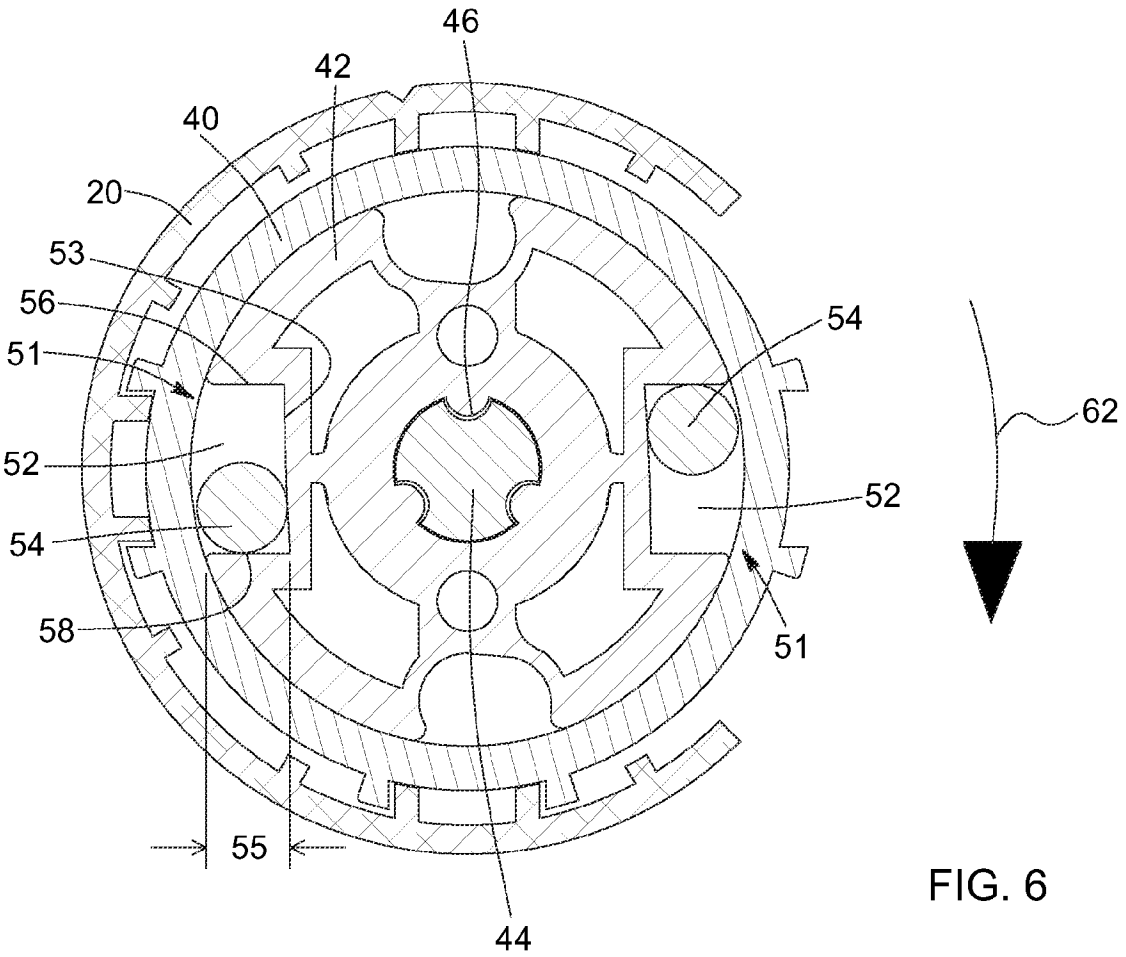
FIG. 6 is a cross-sectional view of the tubular core and braking mechanism of the control mechanism for a roller shade of FIG. 1 wherein the tubular core is rotated in a winding direction.
Figure 7:
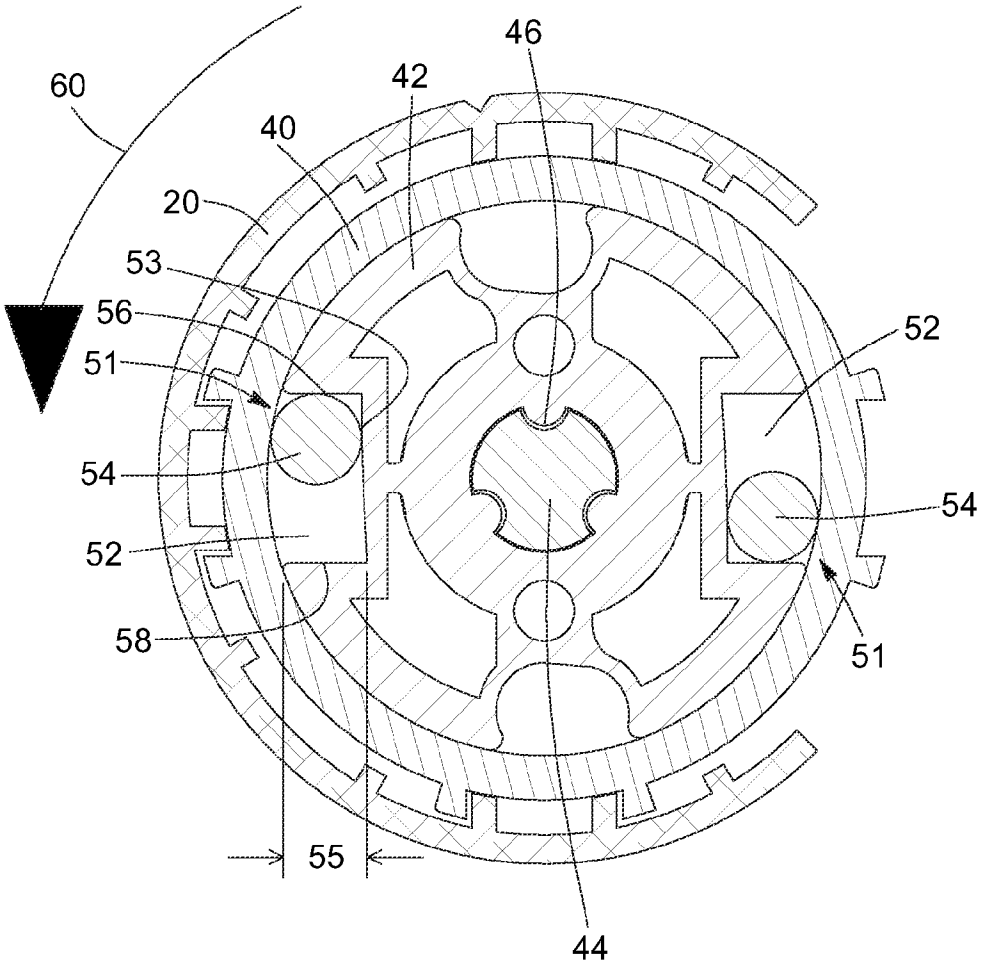
FIG. 7 is a cross-sectional view of the tubular core and braking mechanism of the control mechanism for a roller shade of FIG. 1 wherein the tubular core is rotated in an unwinding direction.

As can be better seen in FIGS. 5 to 7, the braking mechanism is designed to provide a desired temporary resistance between the stationary member 42 and the rotating member 40. In the illustrated embodiment, the desired temporary resistance of the braking mechanism 50 is provided by a connecting assembly 51 formed of the combination of two recesses 52 formed in the stationary member 42, preferably symmetrically arranged around a center of the stationary member 42, and a braking element, for example a brake roller 54, provided in each of the recesses 52. The brake roller 54 can move within each corresponding recess 52 between a first extremity 56 where the brake roller 54 frictionally engages the rotating member 40 to hinder the rotation thereof and a second extremity 58 where the brake roller 54 is loose and does not hinder the rotation of the rotating member 40, and thus disengages the brake roller 54 from the rotating member 40. In another embodiment, another shape of braking element can be used instead of rollers, such as ball-shaped elements.

The shift between the hindering of the rotation of the rotating member 40 when the brake roller 54 is located at the first extremity 56 of the recess 52 (as shown in FIG. 7) and the non-hindering of the rotation of the rotating member 40 when the brake roller 54 is located at the second extremity 58 of the recess 52 (as shown in FIG. 6) occurs as a result of a variation in the depth 55 of the recess 52 between the first extremity 56 and the second extremity 58. Indeed the depth 55 between the edge of the recess and a bottom wall 53 is greater at the second extremity 58 than at the first extremity 56 and is configured to be greater than the diameter of the brake roller 54 at the second extremity 58 and smaller than the diameter of the brake roller 54 at the first extremity 56.

In the illustrated embodiment, the distance between the first extremity 56 and the second extremity 58 of each recess 52, corresponds approximately to the double of the diameter of the brake roller 54 and results in rapid shifting in the position of the brake roller 54 between the first extremity 56 and the second extremity 58.

In operation, as illustrated in FIG. 6, the brake roller 54 in each recess 52 is driven towards the second extremity 58 when the tubular core 20 and the rotating member 40 are rotated in the winding direction 62, where the shade is driven upward to be wound on the tubular core 20. On the contrary, as can be seen in FIG. 7, the brake roller 54 in each recess 52 is driven towards the first extremity 56 when the tubular core 20 and the rotating member 40 are rotated in the unwinding direction 60 where the shade is driven downward after being unwound from the tubular core 20. When no user actuation is provided, the weight of the shade 12 and the weighted hem bar drives the tubular core 20 and the rotating member 40 in the unwinding direction 60, where the hindering of the rotating member 40 created by the braking mechanism 50 in this direction results in the shade being maintained stable. Hence, the shade 12 and hem bar act as biasing elements for biasing the connecting assembly towards an engaged configuration in an absence of rotation of the rotating member. Therefore, it will be understood from the above description that the braking mechanism 50 is active when the shade 12 is unwound or maintained in a stable position, and is inactive when the shade 12 is wound, thereby resulting in a directional braking mechanism allowing easy upward movement of the shade 12.

In alternative embodiments, a different amount of recesses 52 and corresponding brake rollers 54 than the two illustrated in FIGS. 4 to 7 could be provided in the braking mechanism 50. It will be understood that more recesses 52 having a corresponding brake rollers 54 will result in a greater hindering of the rotation of the rotating member 40 in the unwinding direction 60 and that therefore, the amount of required recesses 52 and corresponding brake rollers 54 may vary depending on the weight of the shade 12. In alternative embodiments, supplemental recesses without corresponding brake rollers could be provided. The supplemental recesses could be used to subsequently be provided with supplemental brake rollers if additional brake power is desired.

In the illustrated embodiment of FIGS. 1 to 7, the connection of the actuation assembly 30 with the tubular core 20 is a direct connection. However, as will become more apparent from the description below, these components could also be connected through a gear assembly in order to provide faster winding/unwinding of the shade 12 rolled on the tubular core 20, as the gear assembly provides a multiplication of rotations of the tubular core 20 with respect to displacements of the actuation member.

Figure 8:
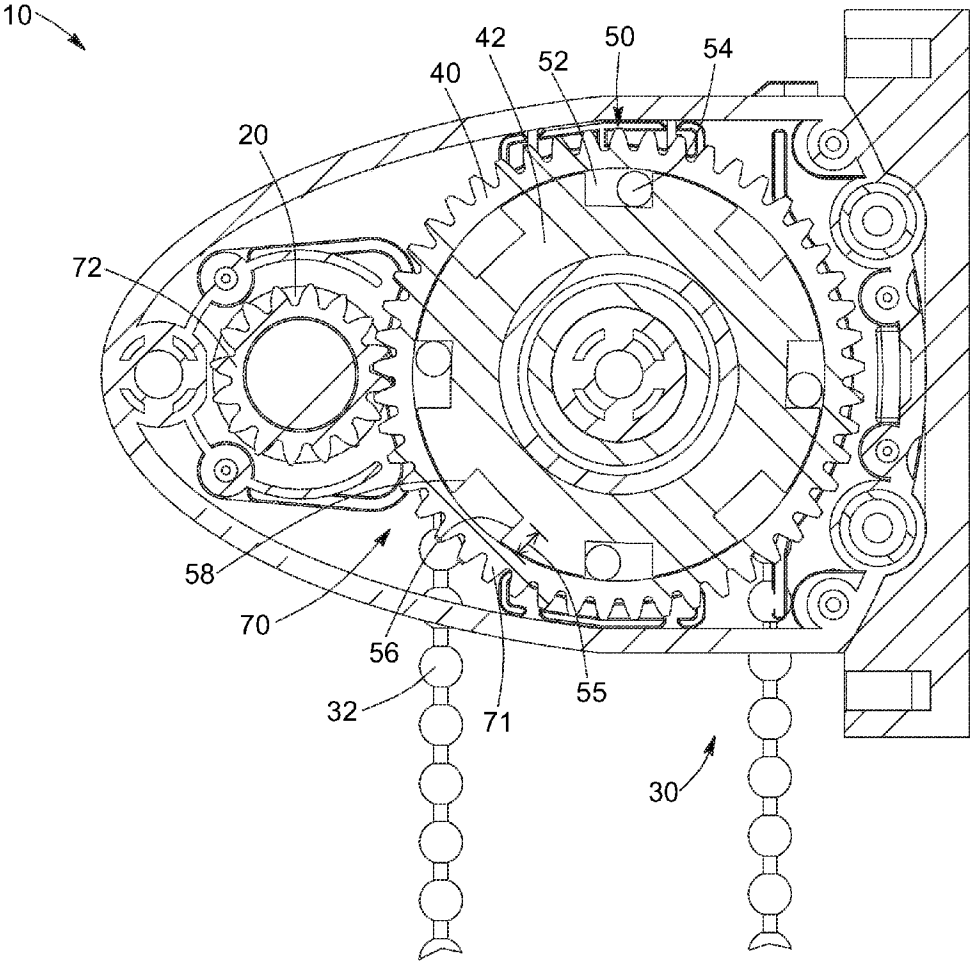
FIG. 8 is a cross-sectional view of a control mechanism for a roller shade according to an embodiment where the braking mechanism is embedded within a gear assembly.

Now referring to FIG. 8, in another embodiment the braking mechanism 50 may be provided within one of the gears of a gear assembly 70. Indeed, in the embodiment shown in FIG. 8, a gear assembly 70 is provided within the actuation assembly 30. The gear assembly 70 has a first rotatable gear 71 and a second rotatable gear 72 meshing with the first rotatable gear 71. The first rotatable gear 71 is driven by the actuation member 32 connected thereto and the second rotatable gear 72 is connectable to the tubular core (not shown). The first rotatable gear 71 is larger than the second rotatable gear 72 in order to produce a gear ratio that results in several rotations of the second rotatable gear 72, and the connectable tubular core, for a single rotation of the first rotatable gear 71. This assembly therefore allows a faster winding/unwinding of the shade onto the tubular core upon a shorter movement of the actuation member 32. Therefore a shorter actuation member 32 with unconnected ends may be provided.

In this embodiment, the rotating member 40 of the braking mechanism 50 is the first rotatable gear 71 and the stationary member 42 is directly connected to the housing to be maintained in a stable position thereon. The first rotatable gear 71 corresponding to the rotating member 40 is rotatably mounted around the stationary member 42 and configured to be freely rotatable thereon, in a winding direction or an unwinding direction.

As previously mentioned, the actuation member 32 of the actuation assembly 30 is connected to the first rotatable gear 71 forming the rotating member 40, in order to allow a user to drive the rotation of the rotating member 40 in the desired direction.

In this embodiment, the functioning of the braking mechanism 50 is similar to what has been described previously in reference with FIGS. 1 to 7. Recesses 52 are formed in the stationary member 42 with a depth greater at a second extremity 58 than at a first extremity 56. In the illustrated embodiment, eight recesses 52 are provided along the periphery of the stationary member 42. Brake rollers 54 are provided in four of the eight recesses 52. One skilled in the art will understand that, in alternative embodiments, a different amount of recesses 52 can be provided, with or without brake rollers 54 inserted within, as long as at least one recess 52 is provided with a corresponding brake roller 54. The presence of supplemental recesses 52 allows the braking force of the braking 50 to be subsequently adjusted by the insertion of brake rollers 54 into existing recesses 52 depending on the intensity of the hindering required when the rotating member 40 is rotated in the unwinding direction or maintained stable.

Similarly to the embodiment of FIGS. 1 to 7, in the embodiment shown in FIG. 8, each brake roller 54 can move within the corresponding recess 52 between the first extremity 56 where the brake roller 54 frictionally engages the first rotatable gear 71 to hinder the rotation thereof and a second extremity 58 where the brake roller 54 does not hinder the rotation of the first rotatable gear 71. The brake rollers 54 are moved to the first extremity 56 when the first rotatable gear 71 is rotated in the unwinding direction (as shown in FIG. 8), and are moved towards the second extremity 58 when the first rotatable gear 71 is rotated in the winding direction (not shown). Once again, when no user actuation is provided, the weight of the shade 12 and the weighted hem bar 14 drives the first rotatable gear 71 in the unwinding direction, and the hindering of the first rotatable gear 71 created by the braking mechanism 50 in this direction results in the shade being maintained in a stable configuration.

One skilled in the art will understand that the braking mechanisms 50 described in reference to the first embodiment of FIGS. 1 to 7 and the second embodiment of FIG. 8 can be used independently in a control mechanism 10. In alternative embodiments, the braking mechanisms 50 described in reference to the first embodiment of FIGS. 1 to 7 and the second embodiment of FIG. 8 can be combined to provide a control mechanism 10 having a first braking mechanism within the gear assembly 70 and a second braking mechanism along the length of the tubular core 20. It will also be understood that the braking mechanism 50 described in reference to the first embodiment of FIGS. 1 to 7 can be used in combination with a gear assembly provided with a non-directional braking mechanism or bi-directional braking mechanism, for example and without being limitative, a bi-directional torsion spring mechanism, or without a braking mechanism. The bi-directional braking mechanism dampens rotational movement of the gear assembly.

Figure 9:
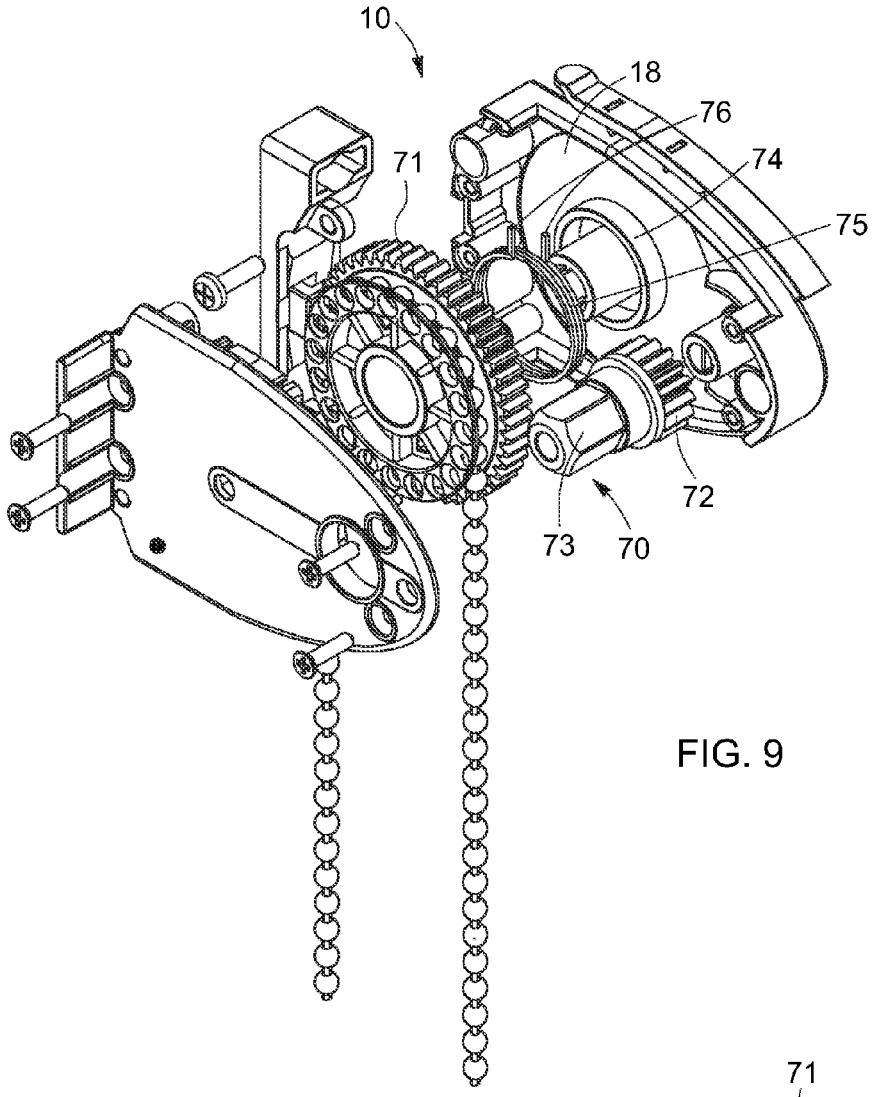
FIG. 9 is an exploded left perspective view of a gear assembly and a braking mechanism embedded therein, according to another embodiment.
Figure 10:
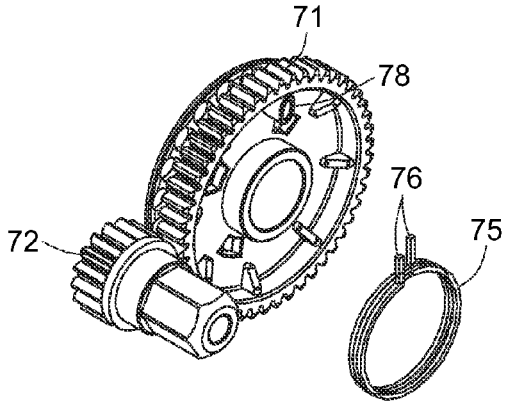
FIG. 10 is an exploded right perspective view showing elements of the gear assembly and braking mechanism of FIG. 10.

FIGS. 9 and 10 present an exemplary embodiment of a control mechanism 10 with a gear assembly 70 having a non-directional braking mechanism located therewithin. In the illustrated embodiment, a spring 75 is mounted on a fixed central hub 74 attached to the housing 18. The spring 75 is configured to frictionally engage the central hub 74 when mounted thereon and be connected to the first rotatable gear 71 of the gear assembly 70. The spring 75 is connected to the first rotatable gear 71 via a pair of tangs 76 extending therefrom and abutting with a connecting bracket 78 provided within the first rotatable gear 71. In operation, when the first rotatable gear 71 is rotated, the connecting bracket 78 abuts one of the tangs 76 of the spring 75 and forces the spring 75 to rotate around the hub 74. The friction between the spring 75 and the hub 74 results in the hindering of the rotation of the first rotatable gear 71 and thereby provides the desired braking.

Similarly to the embodiment of FIG. 8, the gear assembly shown in the embodiment of FIGS. 9 and 10 has a first rotatable gear 71 and a second rotatable gear 72 meshing with the first rotatable gear 71. The first rotatable gear is driven by the actuation member 32 connected thereto and the second rotatable gear 72 is connectable to the tubular core (not shown), via the connecting extension 73. The first rotatable gear 71 is larger than the second rotatable gear 72 in order to produce a gear ratio that results in several rotations of the second rotatable gear 72, and the connectable tubular core, for a single rotation of the first rotatable gear 71. Once again, this results in a faster winding/unwinding of the shade onto the tubular core upon a shorter movement of the actuation member 32.

As will be understood, the braking provided by the above described assembly is non-directional, since the hindering of the rotation of the first rotatable gear 71 occurs regardless of the direction of rotation of the first rotatable gear 71. As previously mentioned, such an assembly can be combined with a braking mechanism 50 provided along the length of the tubular core as described in the embodiment of FIGS. 1 to 7, to result in an overall directional braking device, where a greater braking power is provided in the unwinding direction than on the winding direction.

Figure 11:
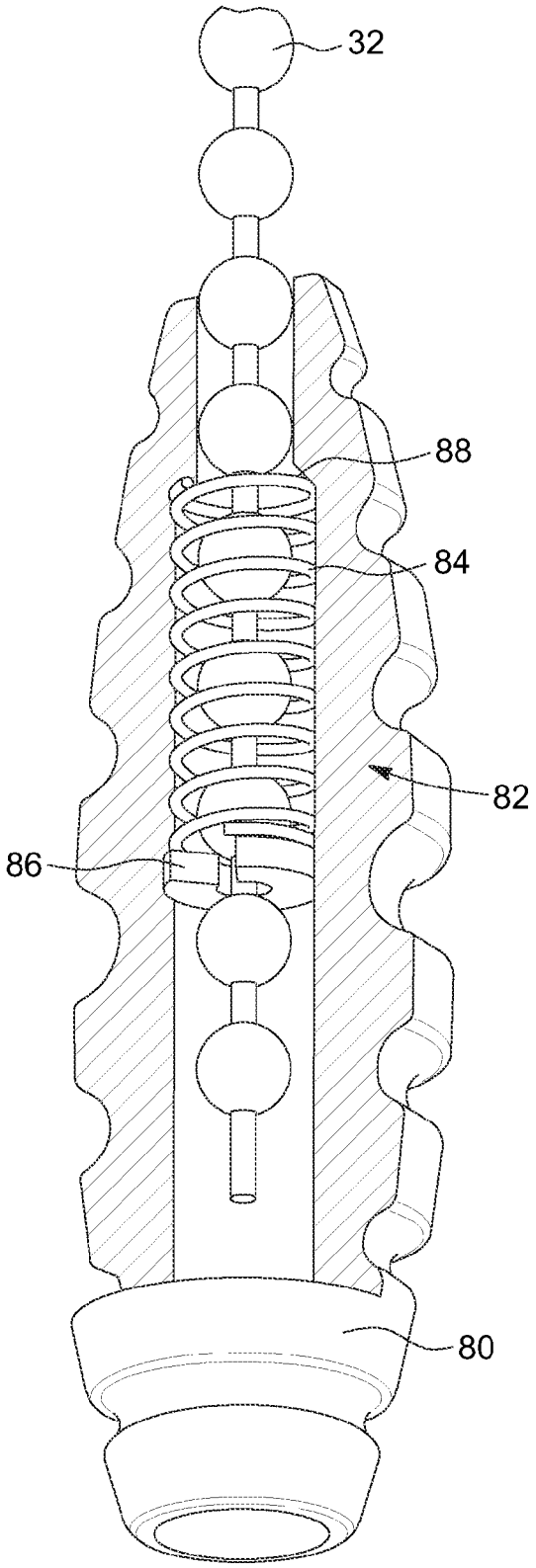
FIG. 11 is a cross-sectional view of a handle for a control mechanism for a roller shade according to an embodiment.

Now referring to FIG. 11, an operating handle 80 may be provided at one of the extremities of the actuation member 32 of the actuation assembly. The operating handle 80 is provided with a dampening mechanism 82 which compensates for the inertia of the shade and therefore offers a fluid operation of the control mechanism 10, by dampening relative motion between the actuation member 32 and the handle 80. The presence of such an operating handle 80 is made possible by the shortening of the actuation member 32 provided by the addition of a gear assembly in the control mechanism and which allows the actuation member 32 to be discontinuous.

In the illustrated embodiment, the dampening mechanism 82 of the operating handle 80 is composed of a resilient member 84, such as, without being limitative, a spring, operatively connecting the handle 80 and the actuation member 32. In order to connect the handle 80 and the actuation member 32 operatively, the resilient member 84 extends between a lower locking ring 86 attached to the actuation member 32 and an upper retaining shoulder 88 formed in the body of the handle 80. However, any configuration which constrains When a user pulls on the handle 80, the resilient member 84 contracts between the lower locking ring 86 and the upper retaining shoulder 88 to provide a gradual pull of the actuation member 32 that compensates the inertia of the shade and reduces the occurrence of a user initially overpulling on the actuation member 32.

One skilled in the art will understand that, in alternative embodiments, different configurations resulting in the body of the operating handle 80 being connected to the actuation member 32 by a resilient member 84 could be provided. For example and without being limitative, the resilient member 48 could be attached to a bottom extremity of the body of the operating handle 80 at one end and be attached to the extremity of the actuation member 32 at a second end, such as to be stretched when a user pulls on the handle 80.

Several alternative embodiments and examples have been described and illustrated herein. The embodiments of the invention described above are intended to be exemplary only. A person skilled in the art would appreciate the features of the individual embodiments, and the possible combinations and variations of the components. A person skilled in the art would further appreciate that any of the embodiments could be provided in any combination with the other embodiments disclosed herein. It is understood that the invention may be embodied in other specific forms without departing from the central characteristics thereof. The present examples and embodiments, therefore, are to be considered in all respects as illustrative and not restrictive, and the invention is not to be limited to the details given herein. Accordingly, while specific embodiments have been illustrated and described, numerous modifications come to mind without significantly departing from the scope of the invention as defined in the appended claims.

The invention claimed is:

1. A braking mechanism for a roller shade control system, the braking mechanism comprising:

a stationary member comprising at least one recess formed therein, the at least one recess having a bottom wall extending between a first extremity having a first depth and a second extremity having a second depth greater than the first depth;

a rotating member rotatable relative to the stationary member, the rotating member being rotatable in a winding direction or an unwinding direction;

a connecting assembly operatively connecting the stationary member and the rotating member, the connecting assembly frictionally engaging the rotating member when the rotating member is rotated in the unwinding direction and being frictionally disengaged from the rotating member when the rotating member is rotated in the winding direction, the connecting assembly comprising a braking element located within at least one of the at least one recess, each braking element having a size and shape to engage the bottom wall and the rotating member at the first extremity and to disengage the bottom wall from the rotating member at the second extremity; and wherein the braking element shifts position and is drivable between the first extremity and the second extremity by rotation of the rotating member, and wherein a diameter of the braking element is less than the first depth at the first extremity and is greater than the second depth at the second extremity.

2. The braking mechanism of claim 1, wherein the braking element is a roller.

3. The braking mechanism of claim 1, wherein the stationary member comprises a plurality of recesses symmetrically arranged around a center of the stationary member.

4. The braking mechanism of claim 1, further comprising a biasing element for biasing the connecting assembly towards an engaged configuration in an absence of rotation of the rotating member.

5. A control mechanism for a roller shade, the control mechanism comprising:

a tubular core onto which the roller shade is wrappable, the tubular core being rotatable in a winding direction or an unwinding direction;

an actuation assembly comprising an actuation member, the actuation assembly being operable to rotate the tubular core in the winding direction or the unwinding direction; and a braking mechanism operatively connected to the actuation assembly, the braking mechanism comprising:

a stationary member comprising at least one recess formed therein, the at least one recess having a bottom wall extending between a first extremity having a first depth and a second extremity having a second depth greater than the first depth;

a rotating member rotatable relative to the stationary member, the rotating member being operatively connected to the tubular core to be rotatable in the winding direction or the unwinding direction simultaneously with the tubular core; and a connecting assembly operatively connecting the stationary member and the rotating member, the connecting assembly frictionally engaging the rotating member when the rotating member is rotated in the unwinding direction and being frictionally disengaged from the rotating member when the rotating member is rotated in the winding direction, the connecting assembly comprising a braking element located within at least one of the at least one recess, each braking element having a size and shape to engage the bottom wall and the rotating member at the first extremity and to disengage the bottom wall from the rotating member at the second extremity; and wherein the braking element shifts position and is drivable between the first extremity and the second extremity by rotation of the rotating member, and wherein a diameter of the braking element is less than the first depth at the first extremity and is greater than the second depth at the second extremity.

6. The control mechanism of claim 5, wherein the actuation member comprises an operating handle at at least one of a first end of the actuation member or a second end of the actuation member, the operating handle having a main body operatively connected to the actuation member by a dampening mechanism for dampening relative motion between the main body and the actuation member.

7. The control mechanism of claim 6, wherein the dampening mechanism comprises a resilient member having a movable end connected to the actuation member, the movable end being displaceable within the main body, and the resilient member being constrained within the main body such that the resilient member resists against relative motion of the actuation member with respect to the main body.

8. The control mechanism of claim 5, wherein the braking element is a roller.

9. The control mechanism of claim 5, wherein the stationary member comprises a plurality of recesses symmetrically arranged around a center of the stationary member.

10. The control mechanism of claim 5, further comprising a biasing element for biasing the connecting assembly towards an engaged configuration in an absence of rotation of the rotating member.

11. The control mechanism of claim 10, wherein the biasing element comprises a weight element comprising at least one of the roller shade and a weighted hem bar.

12. The control mechanism of claim 5, further comprising a gear assembly for multiplying rotations of the tubular core with respect to displacements of the actuation member.

13. The control mechanism of claim 12, further comprising a bi-directional torsion spring operatively connected to at least one gear of the gear assembly for dampening rotational movement thereof.

* * * * *